United States Patent [19]

Palmer et al.

[11] 4,271,345

[45] Jun. 2, 1981

[54] INDUCTION HEATING COIL

[75] Inventors: Wilbur C. Palmer, Corning; Frank L. Rusby, Horseheads, both of N.Y.

[73] Assignee: Corning Glass Works, Corning, N.Y.

[21] Appl. No.: 40,295

[22] Filed: May 18, 1979

[51] Int. Cl.[3] ..... H05B 6/36; H05B 6/10; H01J 9/18

[52] U.S. Cl. ..... 219/10.79; 219/10.57; 219/10.43; 219/10.67; 336/183; 336/223; 29/25.19

[58] Field of Search ..... 219/10.79, 10.57, 10.75, 219/10.73, 10.43, 10.49, 8.5, 7.5, 6.5, 10.67; 336/183, 223, 225; 29/25.19, 25.15

[56] References Cited

U.S. PATENT DOCUMENTS

| | | | |
|---|---|---|---|
| 2,484,650 | 10/1949 | Ross, Jr. | 219/10.75 |
| 3,300,614 | 1/1967 | Sorensen | 219/10.79 |
| 3,381,347 | 5/1968 | Reinwall, Jr. | 29/25.13 |
| 3,443,049 | 5/1969 | Hoagland | 219/10.43 |
| 3,493,358 | 2/1970 | Carstensen et al. | 29/25.15 X |
| 3,495,063 | 2/1970 | Miller | 219/10.79 |
| 3,497,339 | 2/1970 | Eastus | 29/25.19 X |
| 3,534,198 | 10/1970 | Miller | 219/10.79 |
| 3,590,329 | 6/1971 | Krepps, Jr. | 336/183 X |
| 3,721,932 | 3/1973 | Fierstien et al. | 336/183 X |
| 3,892,938 | 7/1975 | DeFosse | 219/10.79 |
| 3,983,612 | 10/1976 | Palmer et al. | 29/25.15 |

*Primary Examiner*—B. A. Reynolds
*Assistant Examiner*—Philip H. Leung
*Attorney, Agent, or Firm*—John P. DeLuca; Burton R. Turner

[57] ABSTRACT

An induction coil heating device is provided to proximately heat an aperture mask support pin in a relatively confined space in the corner of a television panel skirt. A primary coil adapted to receive alternating current power is wound about at least one insulating support member. The primary is loosely wound in a central axial area thereof to provide an annular space, and a secondary coil with a spaced away outrigger output loop inductively coupled to the primary is wound around said support member in the space provided by the primary. The output loop is adapted to receive electrical energy for heating the support pin in response to input energy provided via said primary coil. The output loop is spaced away from the primary and sized so as to be readily insertable in the confined space of the corner of the panel skirt.

7 Claims, 10 Drawing Figures

INDUCTION HEATING COIL

BACKGROUND OF THE INVENTION

The present invention relates to the manufacture of cathode ray tubes and in particular to an apparatus adapted to mount color television shadow mask support pins at corner locations therein.

It has long been believed that a corner mounted rectangular shadow mask exhibits optimum performance. This belief stems from the fact that a shadow mask, when supported at its corners, will flex to follow changes in panel contour shape while providing a more stable spacing relationship to the glass. This will result in improved picture quality compared to the standard mask mounting system.

In the manufacture of conventional television bulbs, support pins are fused into the skirt portion of the panel along major and minor axes. Typically, a conventional induction heating coil is mounted in a traversing frame. A nonferrous vacuum chuck, mounted concentrically with said coil, supports the pin. Each pin is automatically loaded into the vacuum chuck. The induction coil is energized to heat the pin to an operating temperature while the traversing frame lowers itself into the panel and moves axially of the pin in the direction of the panel skirt to fuse the pin into the glass.

The conventional induction coil is water cooled and mounted on a nonferrous ceramic support. In order to deliver sufficient power to the pin for heating during the fusing operation, the coil contains a number of turns, perhaps 8 or 10, and is considerable in size.

In the past, the size of the coil has not been of particular concern since the pins were mounted in a skirt location having sufficient clearance for the coil. Now that corner mounting of support pins has become a preferred arrangement, the size of the coil is important. While details of the present invention will be outlined further in the specification, it will be mentioned here that the conventional coils are too large to properly function in the confined space of the corner areas of the television panel skirt.

Thus, the present invention provides a coil which is particularly adapted for delivering sufficient energy for heating the support pin in the corner portion of a television panel skirt.

SUMMARY OF THE INVENTION

An induction coil heating device is operative to proximately heat an aperture mask support pin in the relatively confined space in the corner of a television panel skirt. A primary coil is wound about at least one insulating support member and receives alternating current power. The primary is loosely wound in a central axial area thereof to provide an annular space, and a secondary coil with a spaced away outrigger output loop is inductively coupled to the primary and wound around said support member in the space provided by the primary. The output loop receives electrical energy for heating the support pin in response to input energy provided via said primary coil. The output loop is spaced away from the primary coil, and sized, so as to be readily insertable in the confined space of the corner of the panel skirt.

FIGS. *2a* and *2b* are respective side and top views of the insertion assembly before and during deep insertion of the support pin.

Figure 3:
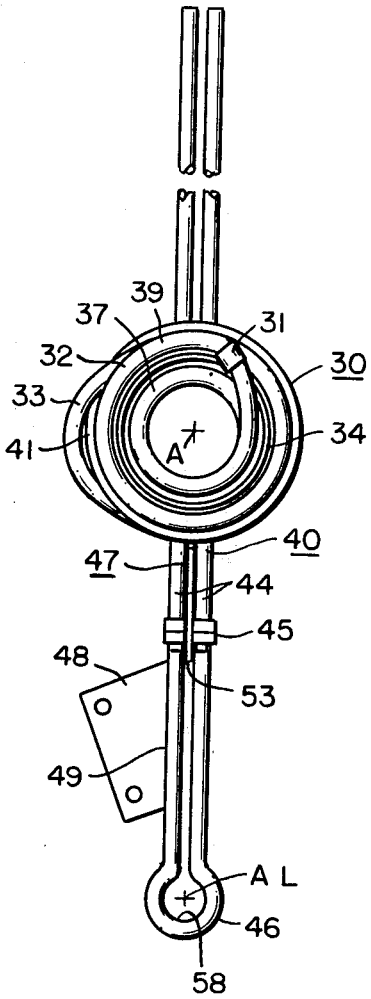

FIG. 3 is an end view of the coil of the present invention.

FIGS. *4a–4f* illustrate in detail various support and insulating components of the coil described herein.

DESCRIPTION OF THE PREFERRED EMBODIMENT

Figure 1:
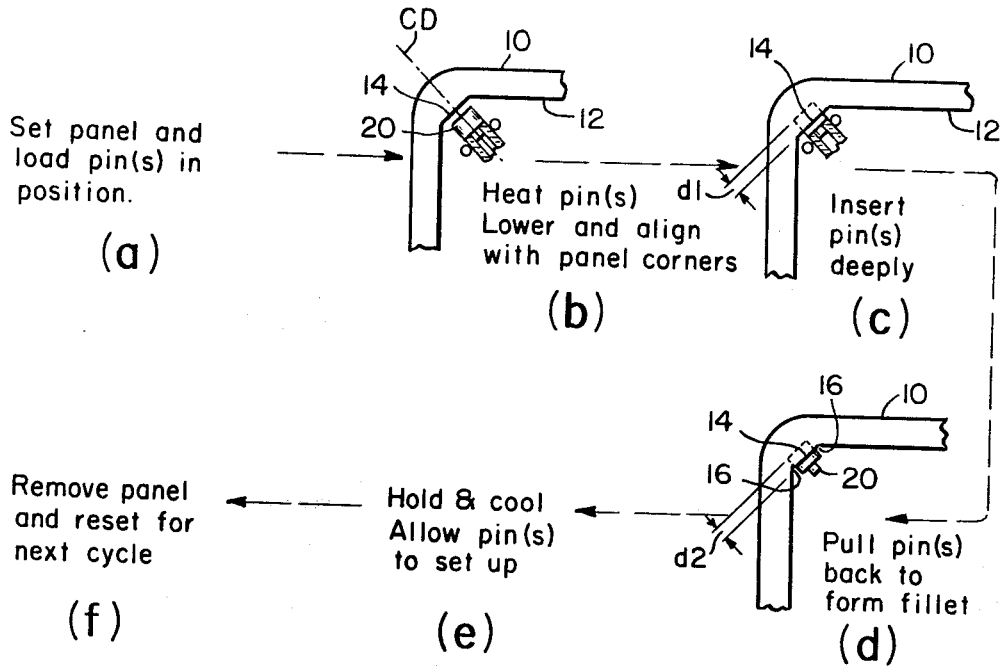
FIG. 1 is a flow diagram showing the various steps of alignment and insertion of a support pin in the corner of a television panel skirt.

FIG. 1 schematically illustrates the sequence during a typical support pin mounting operation. It should be understood that, for the most part, the procedure for aligning and setting the pins in place is the same for both corner and other types of pin mounting. However, corner mounting is illustrated in view of the relation to the present invention. In FIG. 1 at position a, a panel 10 and pin 20, both hereinafter shown, are loaded into position. At position b, the panel 10 and pin 20 are aligned by lowering the pin 20 down into an interior portion of skirt 12. Thereafter, the pin 20 is moved towards an inside corner 14 of said skirt 12. The pin 20 is aligned vertically at a selected position and along center line CD, representing a central axis of the pin 20 and a diagonal of the panel 10. During alignment heat is applied to the pin 20, bringing it to operating temperature. Heating elements are not shown in FIG. 1 but will be hereinafter described in detail. It should be realized that, the panel 10 is also preheated by means known in the art.

At FIG. 1, position c, the pin 20 is slowly inserted into the corner portion 14 to a deep insertion depth d1, exceeding a desired alignment depth d2. At position d, the pin 20 is slowly pulled back from deep insertion to the alignment depth d2, thereby forming a fillet 16 about the pin 20 so that a proper seal is produced. Thereafter, at position e, heat applicaton ceases and the pin 20 is allowed to cool while being maintained in position. Such cooling is permitted so that the glass can set up and fuse solidly with the pin 20. At position f, the panel 10 is removed and reset occurs for the next insertion cycle for a new panel 10. The aforementioned operation occurs simultaneously in each of four corners of the panel 10. The sequence described is fairly conventional except for the positioning of the pin 20.

In FIG. *2a,* there is illustrated a side view of a coil assembly 30, wherein a primary coil 32, hereinafter sometimes referred to as coil or primary 32, is wrapped about an outer insulative cylindrical support member 34. The primary 32 is fed from input leads 36 by an RF power source such as a PO 10KF oscillator manufactured by ECCO High Frequency Corp. (not illustrated herein). The coil 32 and input leads 36 may be copper tubing adapted to carry cooling fluid F (see arrows).

The primary 32 is wrapped around the support member 34 in such a way that an annular space 38 is formed midway along the support member 34 in a plane perpendicular to central axis A thereof. A secondary coil 40, sometimes referred to hereinafter as secondary or coil 40, includes, input leads 42, a central core portion or core 43 coupled thereto and extending through the annular space or slot 38, outrigger leads 44 coupled to core 43; and an output loop 46 joining distal ends of the outrigger leads 44. The secondary 40 is similarly water cooled, and in this preferred embodiment, is a one turn coil.

A mounting tab 48 is welded along seam 49 to one of the outrigger leads 44. The mounting tab is secured to a movable frame member 50 and is coupled to a reciprocal mechanism (not shown) capable of moving in the directions indicated by the arrows 52. The frame member 50 has a hole 54 formed therein, which is aligned axially with an axial centerline AL of the output loop 46, and when in position for insertion, is colinear with the centerline CD of the panel corner 14.

A vacuum chuck 56 is mounted within the hole 54 and is coupled to a vacuum source (not illustrated). The chuck 56 extends forward of the support 50 and into circular open portion 58 of the output loop 46 (see also FIG. 3). The chuck 56 is adapted to mate with the pin 20 and hold it in position while the vacuum is maintained. The pin 20 is supported in the chuck 56 so that it extends beyond a forward portion 60 of the output loop 46.

Figure 2B:
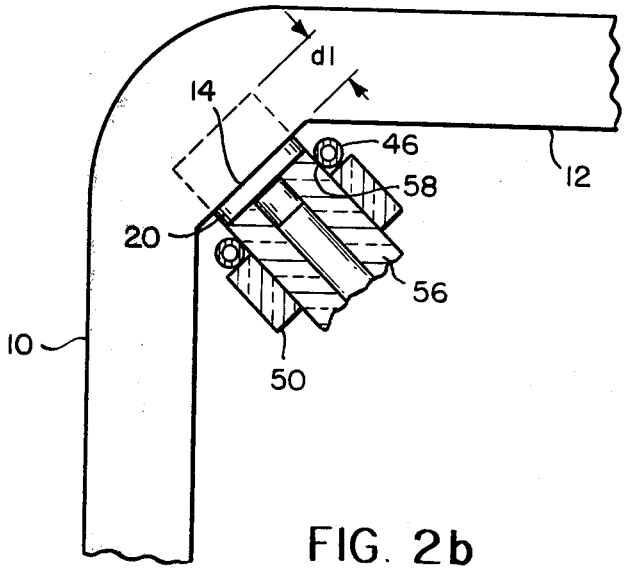
Figure 2A:
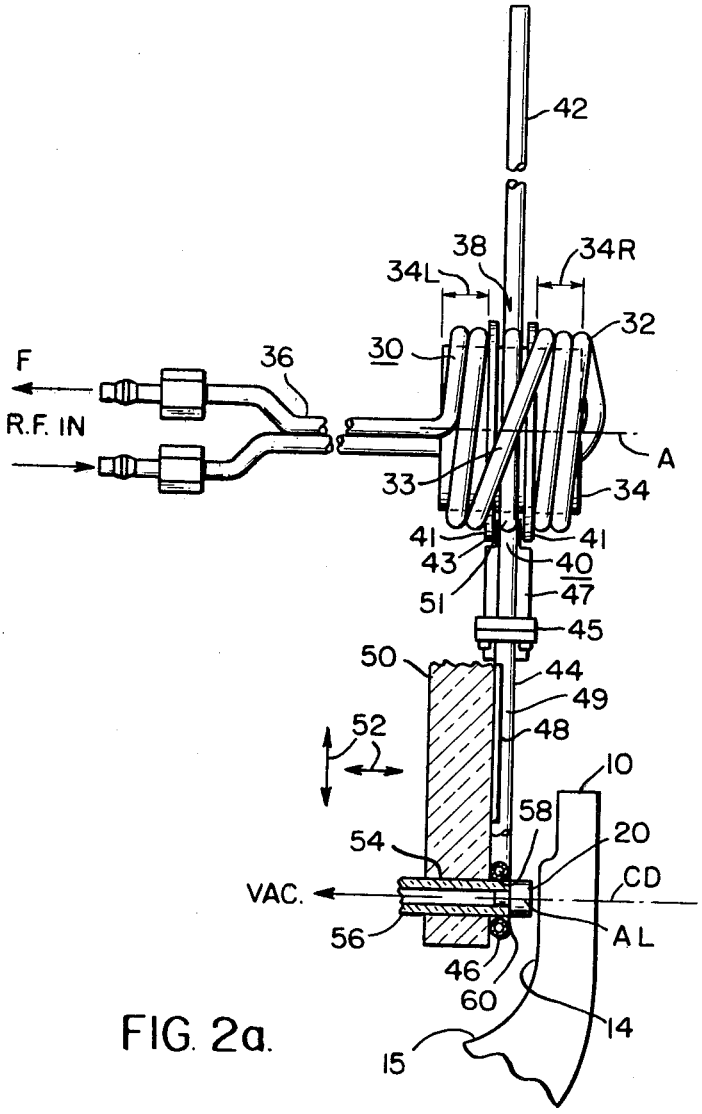

By inspection of the illustrative drawing of FIG. 2*a*, it is clear that the support 50, vacuum chuck 56, output loop 46 and pin 20 have sufficient clearance in the corner area 14 to avoid contact with the lower portion 15 of the panel 10.

In FIG. 2*b*, a less detailed sketch of the apparatus shows that side clearance in the corner portion 14 is sufficient to allow the insertion of the support pin 20 to the deep insertion depth d1.

FIG. 3 shows an end view of the coil assembly 30 without the chuck 56, block 50 and pin 20. Note the arrangement of the primary coil 32 in FIG. 3, wherein a portion 33 thereof extends nonconcentrically off axis A, to allow for the passage of the secondary coil 40 through the primary coil 30. The respective primary and secondary coils 32 and 40 are spaced from each other and hava a coating of appropriate insulating material such as fiber glass and resin which is known in the art. Coupling connectors 45 couple the core 43 via outrigger leads 44 with the output loop 46. An insulating shim 41 is located between the outrigger leads 44 and coupling connectors 45 to maintain separation and prevent a secondary 40 short circuit (see also FIG. 2*a*).

Figure 4A:
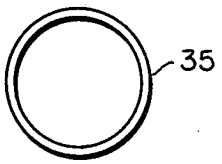
Figure 4B:
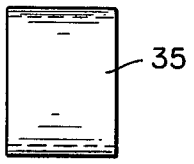
Figure 4C:
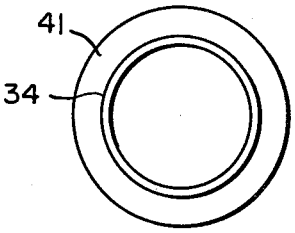
Figure 4D:
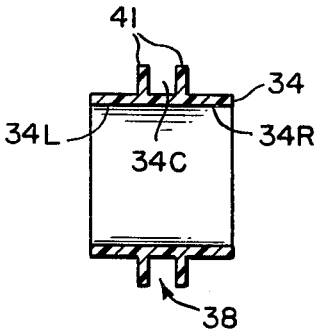

In FIGS. 4*a* and 4*b*, respective end and side views of a cylindrical inner insulative support 35 are illustrated. Inner support 35 is sleeved within outer support 34 (see FIG. 4*c*). Specific description thereof is believed to be unnecessary due to the simplicity of the member. In FIGS. 4*c* and 4*d*, respective end and side views of an outer insulative support 34 are illustrated. The outer support 34 has two annular fins 41 which act as spacers for the turns of the primary coil 32.

The primary 32 is formed with a number of turns or windings, referred to as respective internal and external turns 37 and 39 (see FIG. 3). Internal turns 37 are wrapped a number of times inwardly of inner support 35 (not shown in FIG. 3 for clarity) and thence via coupler 31 are wrapped outwardly of outer support 34. This arrangement compacts the turns, helps to reduce the overall size of the primary coil 32 and provides adequate coupling to the secondary 40.

To further illustrate the compact nature of the present invention, attention is directed to FIG. 2*a* and FIGS. 4*c* and 4*d*. The outer support 34 has a right side outboard zone 34R which receives a number of the outer turns 39 of the primary coil 32, and thence, via the offset portion 33 of the primary 32, opposed left side outboard zone 34L receives the remaining turns of the primary 32. Central zone 34C, provided between the annular fins 41, establishes annular space 38 which is reserved for the location of the secondary coil 40. The fins 41 provide not only spacers for separating the primary 32 and secondary 40, but provide insulative integrity between the coils.

Figure 4E:
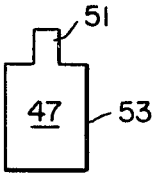
Figure 4F:
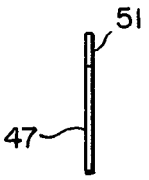

In FIGS. 4*e* and 4*f*, respective front and side views of the insulating tab 47 are shown. Tongue 51 portion is adapted to be inserted between the fins 41 and wider shim portion 53 extends beyond the coupler 45 to assure that the outrigger leads 44 do not come in contact with each other (see also FIGS. 2A and 3).

An important feature of the present invention is the utilization of a two-stage heating coil, that is, the use of a primary coil 32 for coupling energy to a secondary coil 40 which has an output loop 46 remotely located from the primary source. Conventional inductive coils, for use in pin sealing applications, normally use only a single stage coil located adjacent the pin sealing area. Due to the necessary space constraints of corner pin sealing, the present invention provides for the remotely located secondary output loop 46 driven by the primary coil 32.

While there has been described what at present is considered to be the preferred embodiment of the present invention, it will be obvious to those skilled in the art that various changes and modifications may be made therein without departing from the invention, and it is intended in the appended claims to cover all such changes and modifications as fall within the true spirit and scope of the invention.

We claim:

1. An induction coil for heating a support pin in a confined location comprising: a primary coil assembly having a selected number of respective inner and outer turns, a cylindrical tube having an axial extent substantially the same as an axial extent of the primary coil disposed concentrically between said inner and outer turns, said outer turns being spaced apart near an axially central location of said primary coil, at least two integral annular surface portions extending radially outwardly of said cylindrical tube and being spaced substantially equidistant to either side of the axial central location, for forming boundaries of the space in said primary coil, a secondary coil located in the space near the axial central location and supported by said cylindrical tube, said secondary coil including input leads and outrigger leads at each free end thereof, and an output loop located at a free end of said outrigger leads, said output loop being spaced from and off axis of said primary coil and forming at least a one turn secondary coil, said primary coil having an offset outer turn electrically isolated from the secondary coil and to bridge the space provided in said primary coil, and the spacing of said annular surface portions is at least equal to the width of one turn of said secondary coil and said annular surface portions extend radially outwardly at least a distance sufficient to electrically insulate the primary and secondary coils, and an insulating shim located between said outrigger leads for insuring electrical isolation of one lead to the other, the primary and secondary coils being electrically coupled by induction, said primary coil being adapted to be energized by AC power and said secondary being responsive to induced current produced thereby to produce a resulting strong electrical output in the vicinity of said output loop, said output loop being sized so as to be capable of close proximate relation within relatively closely spaced locations.

2. The induction coil of claim 1 wherein each of said primary and secondary coils comprise conductors adapted to carry a cooling fluid therethrough.

3. The induction coil of claim 1 wherein said primary and secondary conductor coils are adapted when operative to carry radio frequency energy of sufficient magnitude to heat the pin to relatively high temperatures by induction.

4. The induction coil of claim 1 wherein said secondary coil is formed as a continuous member from a grounded input lead substantially diametric with said primary coil extending semicircularly about said primary coil, thence diametrically along outrigger lead, to one end of said output loop circularly around to another of said outrigger leads diametrically with said primary coil and semicircularly around same to an opposite grounded input lead thus forming at least the one turn secondary coil.

5. The induction coil of claim 1 wherein one of said outrigger leads includes a support tab secured thereto, which tab is movably supported.

6. The induction coil of claim 5 including: a movable frame member coupled to said support tab having a through hole therein axially aligned with a central location of said output loop and a vacuum chuck sleevably mounted in said hole and extending interiorly of said output loop, said vacuum chuck having a bore therethrough and axial with said hole in said support tab, said hole extending from the end located in the output loop which opening is adapted to receive therein a portion of said pin and support it under vacuum.

7. The induction coil of claim 1 further including a second insulative cylindrical support member sleeved concentrically with and having the same axial extent as said first member.

* * * * *